US007484628B2

(12) United States Patent
Schneider

(10) Patent No.: US 7,484,628 B2
(45) Date of Patent: Feb. 3, 2009

(54) ANTI-SWEEP ASSEMBLY AND APPARATUS

(75) Inventor: Raymond M. Schneider, Port Washington, NY (US)

(73) Assignee: Display Technologies, College Point, NY (US)

( * ) Notice: Subject to any disclaimer, the term of this patent is extended or adjusted under 35 U.S.C. 154(b) by 225 days.

(21) Appl. No.: 11/415,673

(22) Filed: May 1, 2006

(65) Prior Publication Data

US 2006/0266899 A1 Nov. 30, 2006

Related U.S. Application Data

(60) Provisional application No. 60/676,584, filed on Apr. 29, 2005.

(51) Int. Cl.
*A47F 7/00* (2006.01)

(52) U.S. Cl. ..... 211/57.1; 211/47; 211/51; 248/551

(58) Field of Classification Search ..... 211/57.1, 211/47, 51, 53, 59.2, 59.3; 248/551
See application file for complete search history.

(56) References Cited

U.S. PATENT DOCUMENTS 3,785,501 A 1/1974 Canning
4,289,242 A * 9/1981 Kenyon ..... 211/4
4,474,300 A 10/1984 Entis
5,009,334 A 4/1991 Bodkins
5,014,949 A 5/1991 Niven
5,082,215 A * 1/1992 Hutchison ..... 248/220.22
5,088,606 A * 2/1992 Boas ..... 211/57.1
5,375,725 A 12/1994 Rosenthal
5,499,723 A 3/1996 Morrow
5,542,633 A 8/1996 Nagel
5,597,150 A 1/1997 Stein
5,711,432 A 1/1998 Stein
7,197,902 B1 * 4/2007 Barkdoll ..... 70/57.1

* cited by examiner

*Primary Examiner*—Amy J. Sterling
(74) *Attorney, Agent, or Firm*—Carter, DeLuca, Farrell & Schmidt, LLP

(57) ABSTRACT

An anti-sweep apparatus for engagement with a wire which holds articles is disclosed. The anti-sweep apparatus includes a first portion, a second portion disposed proximate to the first portion and a camming surface disposed on the first portion. The camming surface is engagable by a portion of a lead article on the wire to cam the anti-sweep apparatus between an enabling orientation and a blocking orientation. In the enabling orientation, the lead article is removable from the wire. In the blocking orientation, a second article is prevented from being removed from the wire. The first portion and the second portion are lockable with each other and are sized to at least partially encapsulate a portion of the wire therebetween. When the lead article is moved proximally, the lead article engages the camming surface and causes the anti-sweep apparatus to move between its enabling orientation and its blocking orientation.

13 Claims, 7 Drawing Sheets

ANTI-SWEEP ASSEMBLY AND APPARATUS

CROSS-RELATED TO RELATED APPLICATION

The present application claims the benefit of and priority to U.S. Provisional Application No. 60/676,584, filed Apr. 29, 2005, the entire contents of which are incorporated herein by reference.

BACKGROUND

The present disclosure relates to an anti-sweep assembly for limiting a plurality of articles from being removed from a wire, and more particularly relates to an anti-sweep peg assembly enabling only one article to be removed at a time. This disclosure also relates to an anti-sweep apparatus to be placed on a typical peg hook which allows a single article to be removed from the peg hook at a time.

Various articles that are offered for sale typically incorporate a slot which enables the articles to be mounted on a peg hook. The slots may be any regular or irregular shape including circular or elongate in the horizontal or vertical directions. The peg hooks serve the function of compactly storing the articles for sale and at the same time providing the prospective purchaser with a clear view of the front of the product. The peg hooks may be mounted at one end to an appropriate peg board, wall or stand (whether rotatable or stationary).

The conventional peg hook permits the easy removal of not just the forward or leading article, but a plurality or series of the following articles as well. Thus, hit-and-run thieves may enter a retail establishment, grab a whole row of the articles on a peg hook, and, with a single movement, sweep the entire row of articles from the peg hook in a fairly rapid operation. The thief may then either simply run away with the loot or rapidly conceal the articles and slowly withdraw from the retail establishment.

This type of stealing can be prevented if the peg hook enables only a single article to be removed from the peg hook at a time. In such an embodiment, a thief must stand in front of the peg hook, grabbing one article at a time. The longer he or she must stand there removing the articles one-by-one from the peg hook, the greater the likelihood of the thief being noticed and apprehended.

The problem of pilfering from peg hook mounted displays is well recognized in the prior art as exemplified by U.S. Pat. No. 3,785,501 (a coin-operated system), U.S. Pat. No. 4,474,300 (a key-operated system), U.S. Pat. No. 5,009,334 (using a close-fitting cage about the front of the peg hook) and U.S. Pat. No. 5,014,949 (using an undulating peg hook). Unfortunately, each of these approaches to solving the problem of pilferage has, in one way or another, defeated the very purposes for which the peg hook display is intended. Thus, the simple, generally horizontal movement of even the forward or leading article is no longer sufficient, and, in the worst cases, extraneous elements such as coins or keys are necessary to enable removal of an article from the peg hook. For example, for undulations of the peg hook to be sufficient to impede pilferage, the undulations must be so exaggerated that the removal of even the forward or leading article becomes more of an up-and-down motion than a generally horizontal motion on the part of the potential customer. Furthermore, if a series of the articles are loosely held by the thief, several articles can be forced past the undulations (with the several articles moving up and down as necessary to accommodate the undulations), although the number of articles which can thus be removed by a thief in a single swipe is minimized.

Another device which deals with the problem of pilfering from a peg hook is disclosed in U.S. Pat. No. 5,711,432 issued to Stein et al. on Jan. 27, 1998, the contents of which hereby being incorporated by reference herein. This device includes a apparatus and a peg hook. The peg hook contains slots to accept the apparatus, which is snapped thereto. Therefore, if a conventional peg hook is used, it must be modified to accept the apparatus. Further, since the apparatus snaps to the peg hook, it can potentially be unsnapped by anyone, including a thief.

The present disclosure includes an apparatus which can be installed onto a typical, unmodified peg hook. The apparatus can be installed to peg hooks that are already in use in stores. The apparatus of present disclosure can be wrapped around part of the wire of a peg hook, thus fully capturing the wire inside the apparatus and preventing the removal of the apparatus.

SUMMARY

The present disclose relates to an anti-sweep apparatus for engagement with a wire (e.g., an unmodified wire or peg hook) which holds articles. The anti-sweep apparatus includes a first portion, a second portion disposed proximate to the first portion and a camming surface disposed on the first portion. The camming surface is engagable by a portion of a lead article on the wire to cam the anti-sweep apparatus between an enabling orientation where the lead article is removable from the wire and a blocking orientation where a second article is prevented from being removed from the wire. The first portion and the second portion are lockable with each other and are sized to at least partially encapsulate a portion of the wire therebetween. When the lead article is moved proximally, the lead article engages the camming surface and causes the anti-sweep apparatus to move between its enabling orientation and its blocking orientation.

In an embodiment of the present disclosure, the anti-sweep apparatus includes a distal tab and/or a proximal tab. The distal tab is disposed on the first portion and distal of the camming surface. The distal tab is configured to contact the wire when the anti-sweep apparatus is in the enabling orientation. The proximal tab is disposed on the first portion and proximal of a portion of the camming surface and is configured to contact the wire when the anti-sweep apparatus in is the blocking orientation.

Another embodiment of the present enclosure includes a living hinge disposed between the first portion and the second portion. Further at least one of the first portion and the second portion may include a locking structure disposed thereon.

The present disclosure also relates to an anti-theft assembly including a wire, an anti-sweep apparatus (similar to the anti-sweep apparatus disclosed above) and an anti-theft device. The wire is insertable into at least one hole on a structure and includes a proximal portion and a distal portion. The wire (e.g., a peg hook) is capable of holding a plurality of articles thereon. The anti-sweep apparatus is disposed adjacent the proximal portion of the wire. The anti-theft device is disposed adjacent the distal portion of the wire and hinders the removal of the wire from the structure. In an embodiment, the anti-theft device includes at least one of a rotation lock and a spring lock.

The present disclosure also relates to a method for enabling a plurality of articles to be individually dispensed from a wire (e.g., a peg hook). The method includes the steps of providing a wire, providing an anti-sweep apparatus (similar to the anti-sweep apparatus disclosed above), placing the anti-sweep apparatus on a portion of the wire and placing a plurality of articles on the wire.

Another embodiment of the disclosed method includes providing an anti-theft device (e.g., a rotation lock and/or a lock spring) disposed adjacent a distal portion of the wire and which hinders the removal of the wire from a structure.

BRIEF DESCRIPTION OF THE DRAWINGS

Embodiments of the present disclosure are described hereinbelow with reference to the figures wherein.

DETAILED DESCRIPTION OF PREFERRED EMBODIMENT

Figure 1:
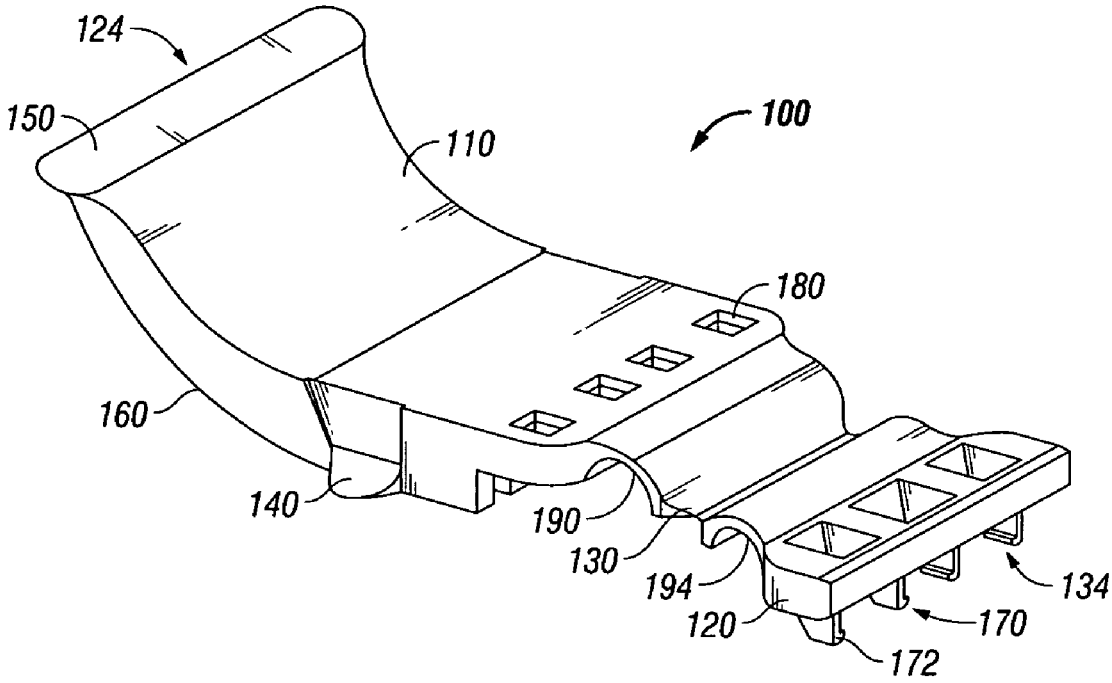
FIG. 1 is a perspective view of an anti-sweep apparatus of the present disclosure, illustrated in an unfolded position.
Figure 2:
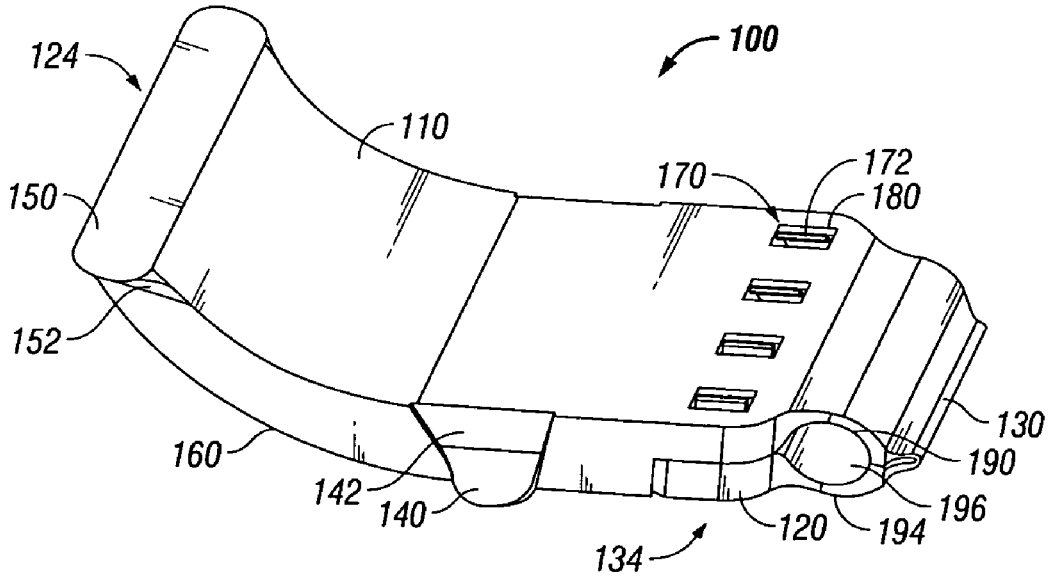
FIG. 2 is a perspective view of the anti-sweep apparatus of FIG. 1, illustrated in a folded position.

Referring now to the figures, and in particular to FIGS. 1 and 2, an anti-sweep apparatus according to the present disclosure is shown and is generally referred to by reference numeral 100. Anti-sweep apparatus 100 is designed to be wrapped around a peg hook or a wire 200 (see FIG. 3) and locked to itself. Anti-sweep apparatus 100 enables articles, generally referred to by reference numeral 400 (see FIGS. 4-7), to be removed from wire 200 one at a time, as described in more detail below. A wide variety of products are frequently sold in packages designed to be dispensed from wire 200, including batteries, eyeglasses, razors, etc. In the figures and in the descriptions which follow, the term "proximal," as is traditional, will refer to the end of anti-sweep apparatus 100 which is closer to the user, while the term "distal" will refer to the end which is farther from the user.

Anti-sweep apparatus 100 includes a first portion 110, a second portion 120, a distal portion 124, a living hinge 130, a proximal portion 134, a proximal tab or set of tabs 140 (only a single tab is shown), a distal tab 150, a camming surface 160, locking structure 170, a first wire-encapsulating portion 190 and a second wire-encapsulating portion 194.

Figure 3:
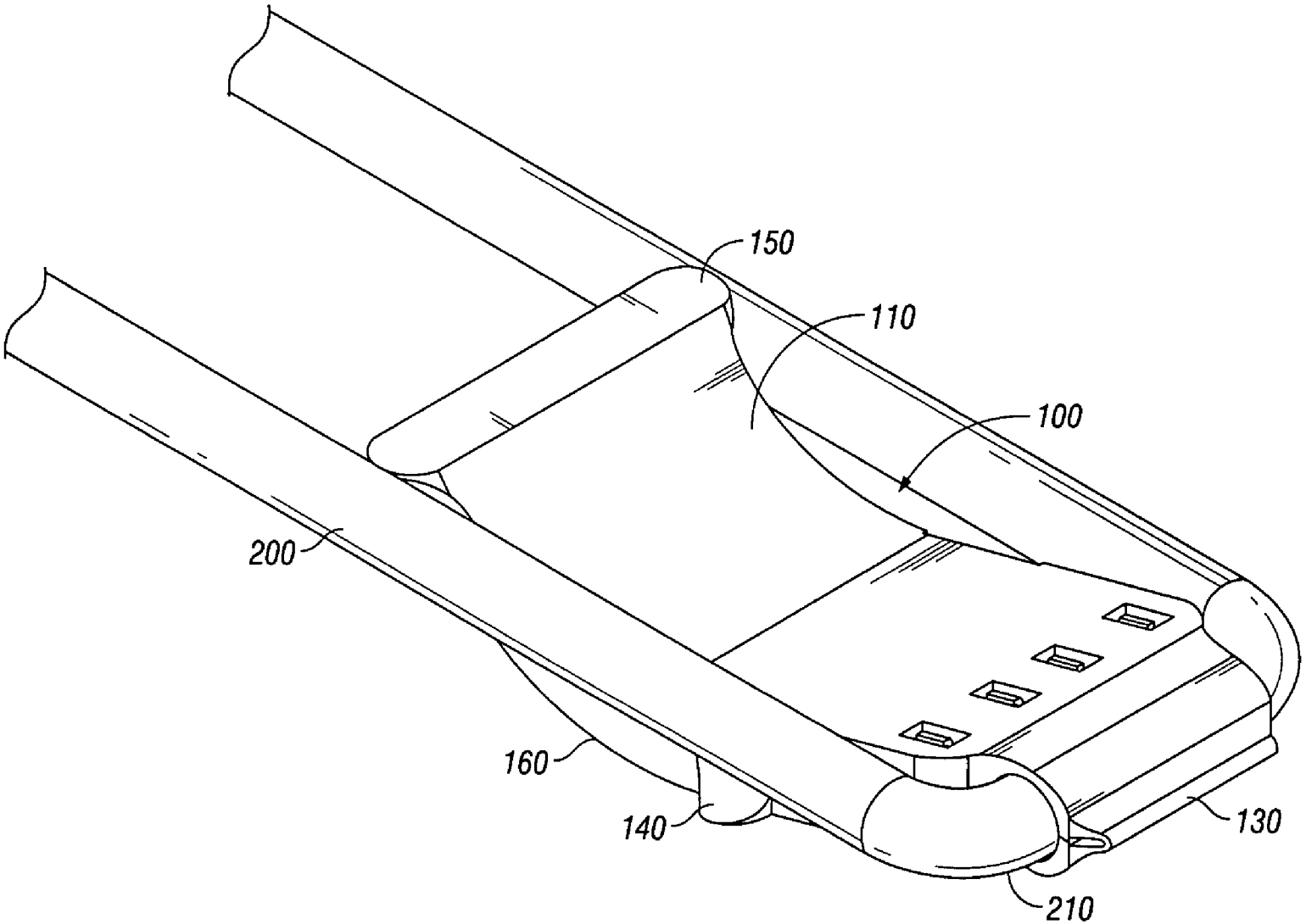
FIG. 3 is a perspective view of the anti-sweep apparatus of FIG. 2, shown in a folded position and locked around a wire.

As shown in FIGS. 1 and 2, second portion 120 may be moved or folded (e.g., about living hinge 130) relative to first portion 110 and locked into place by inserting a male portion 172 of locking structure 170 into a female portion 180 of locking structure 170, thus locking first portion 110 with second portion 120. When in a locked position, an opening 196 is created between first portion 110 and second portion 120 to at least partially encapsulate a portion of wire 200. Specifically, first wire-encapsulating portion 190 and second wire-encapsulating portion 194 may combine to form opening 196. Other suitable locking structures 170 for permanently, semi-permanently or temporarily locking anti-sweep apparatus 100 around a portion of wire 200 are envisioned. For example, locking structure 170 may include an adhesive, a two-part epoxy, a hook and eye assembly, a lockable latch, etc. As shown in FIG. 3, a proximal portion 210 of wire 200 is captured by opening 196 of folded anti-sweep apparatus 100. When in a folded position, as shown in FIG. 3, proximal set of tabs 140 is disposed below wire 200 and distal tab 150 rests on wire 200. Radiuses 142 and 152 (FIG. 2) of proximal set of tabs 140 and distal tab 150, respectively, enable anti-sweep apparatus 100 to be inserted onto wire 200, without any special detents or cut-outs in wire 200. Accordingly, since there is no need to modify wire 200, anti-sweep flippers 100 can be installed on unmodified wires that are already in use in various retail establishments. Further, anti-sweep apparatus 100 may be dimensioned and configured to be capable of being installed onto a wide variety of wires.

Figure 4:
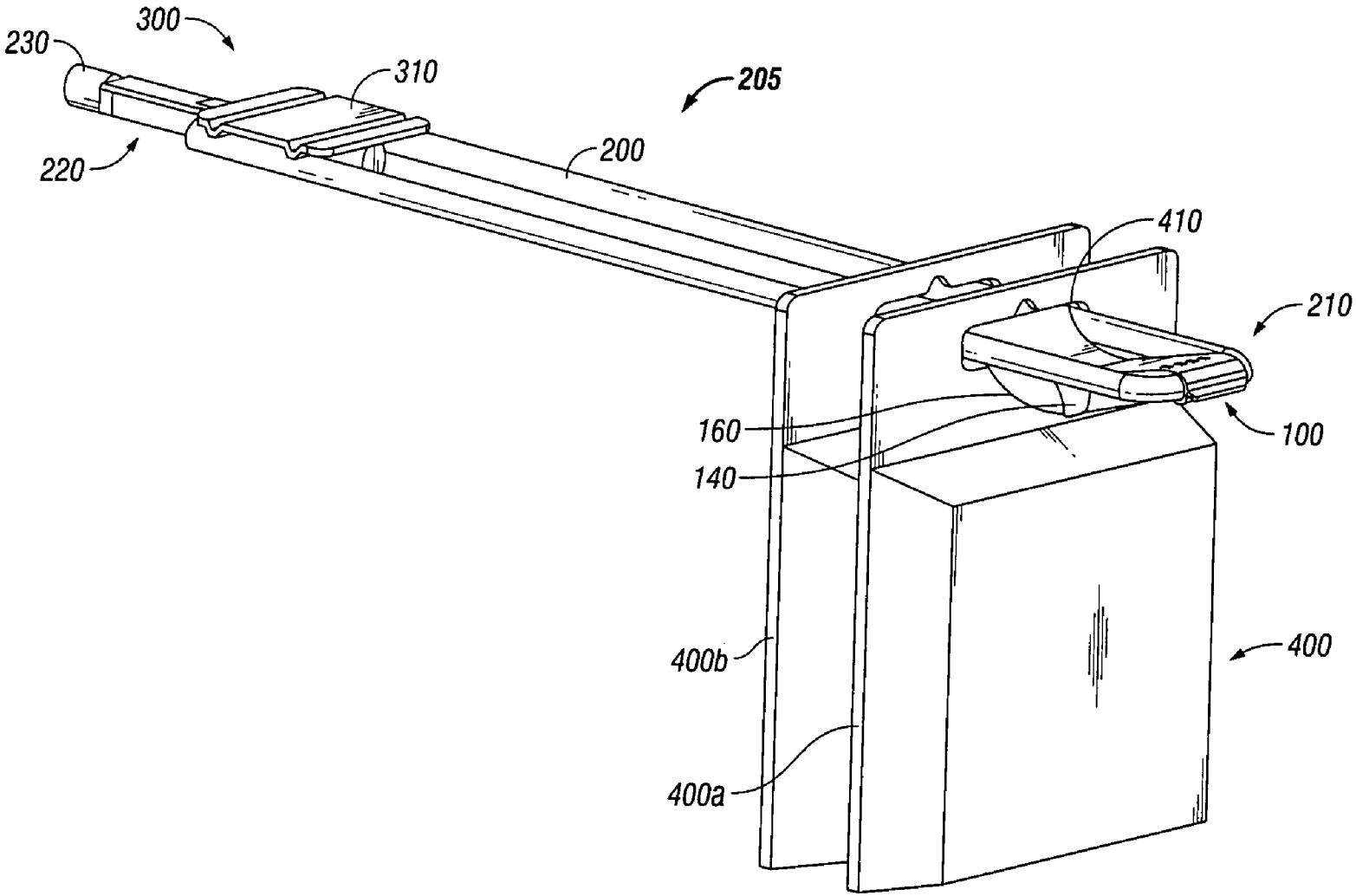
FIG. 4 is a perspective view of an anti-sweep peg assembly, the anti-sweep peg assembly including the anti-sweep apparatus and wire of FIG. 3 and a rear anti-theft device disposed adjacent the rear portion of the wire, the anti-sweep apparatus illustrated in an enabling orientation and two articles are illustrated on the wire.
Figure 5:
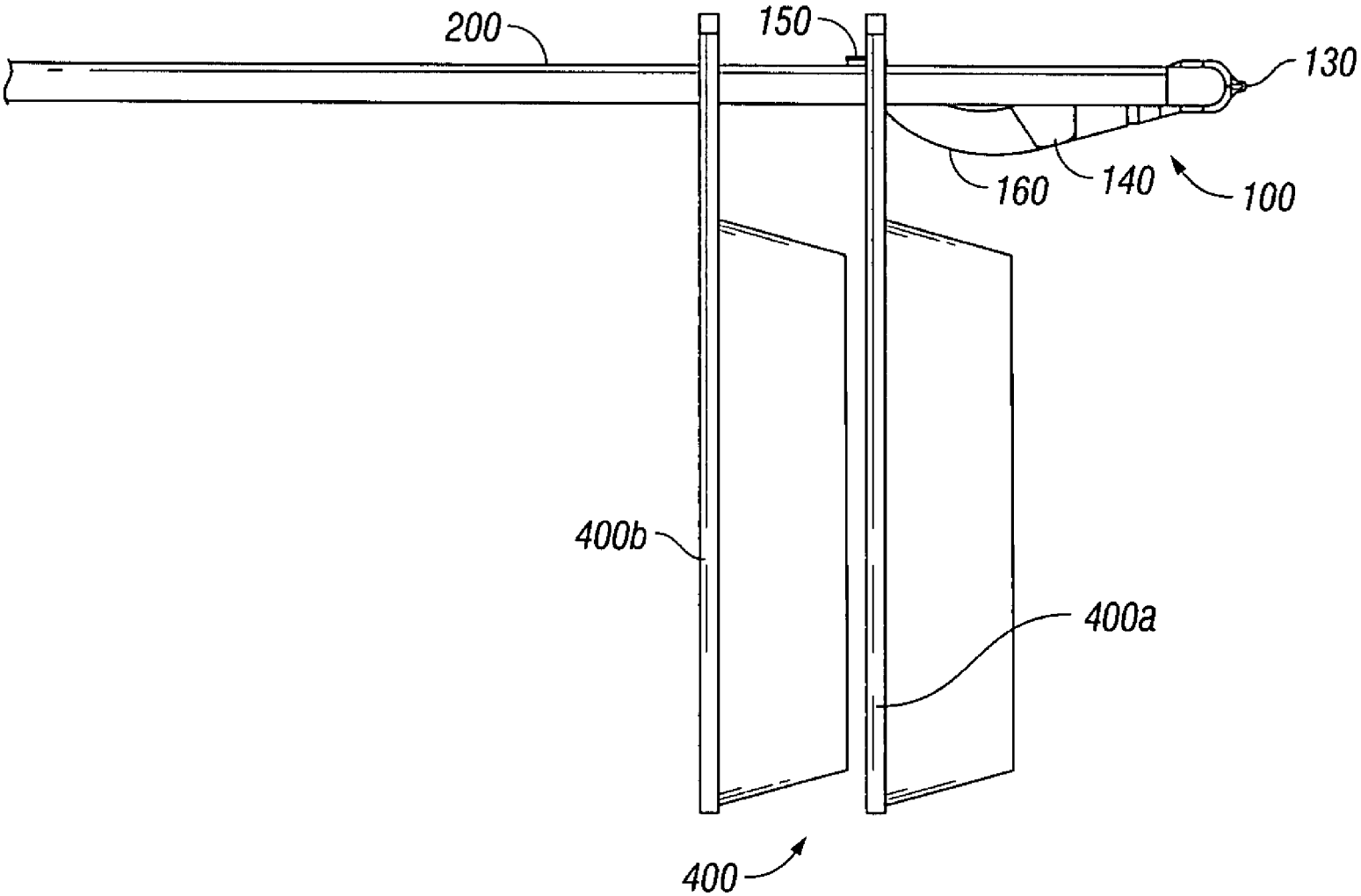
FIG. 5 is a side view of the anti-sweep apparatus and wire of FIG. 4.
Figure 6:
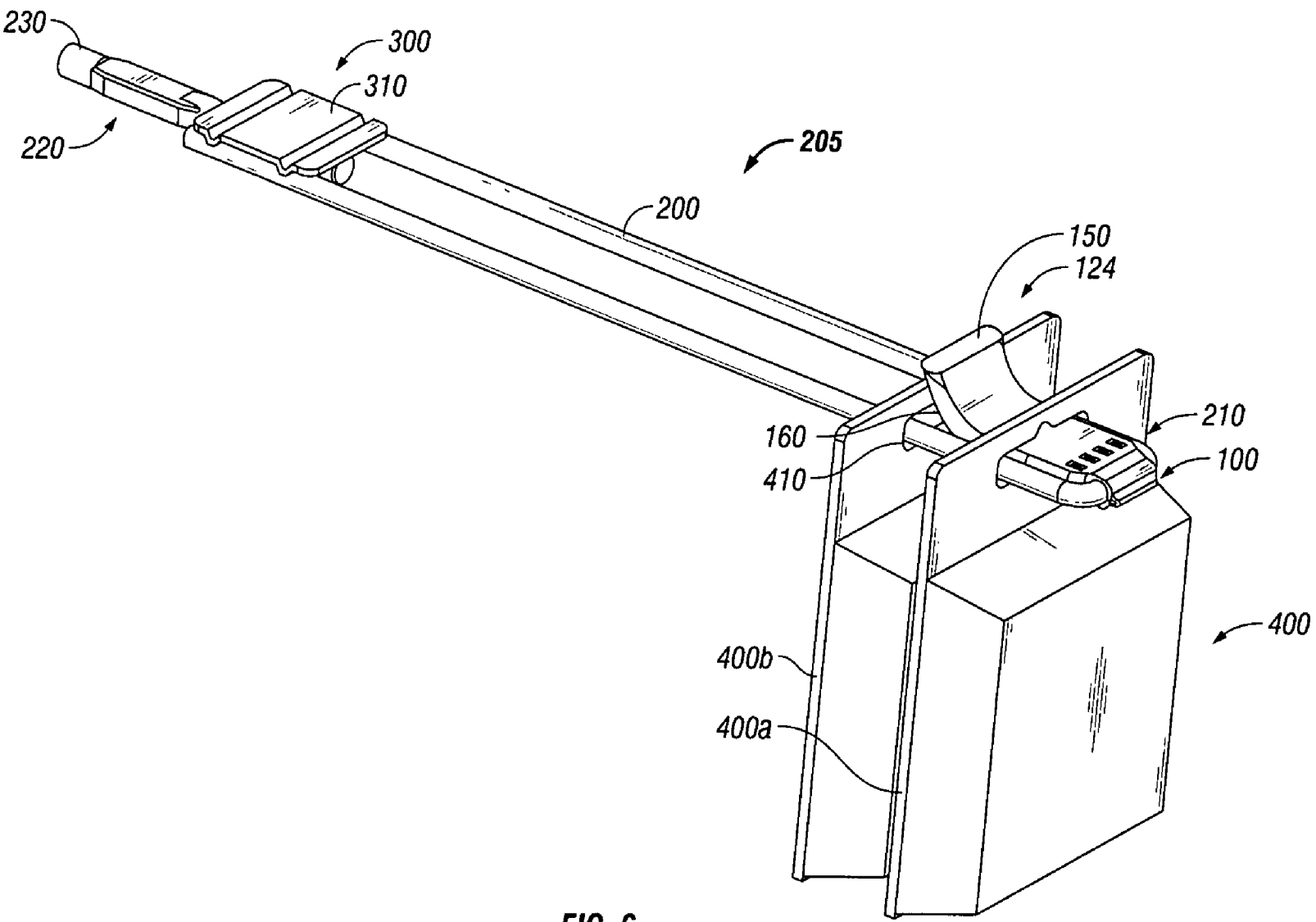
FIG. 6 is a perspective view of the anti-sweep peg assembly of FIG. 4, the anti-sweep apparatus illustrated in a blocking orientation.
Figure 7:
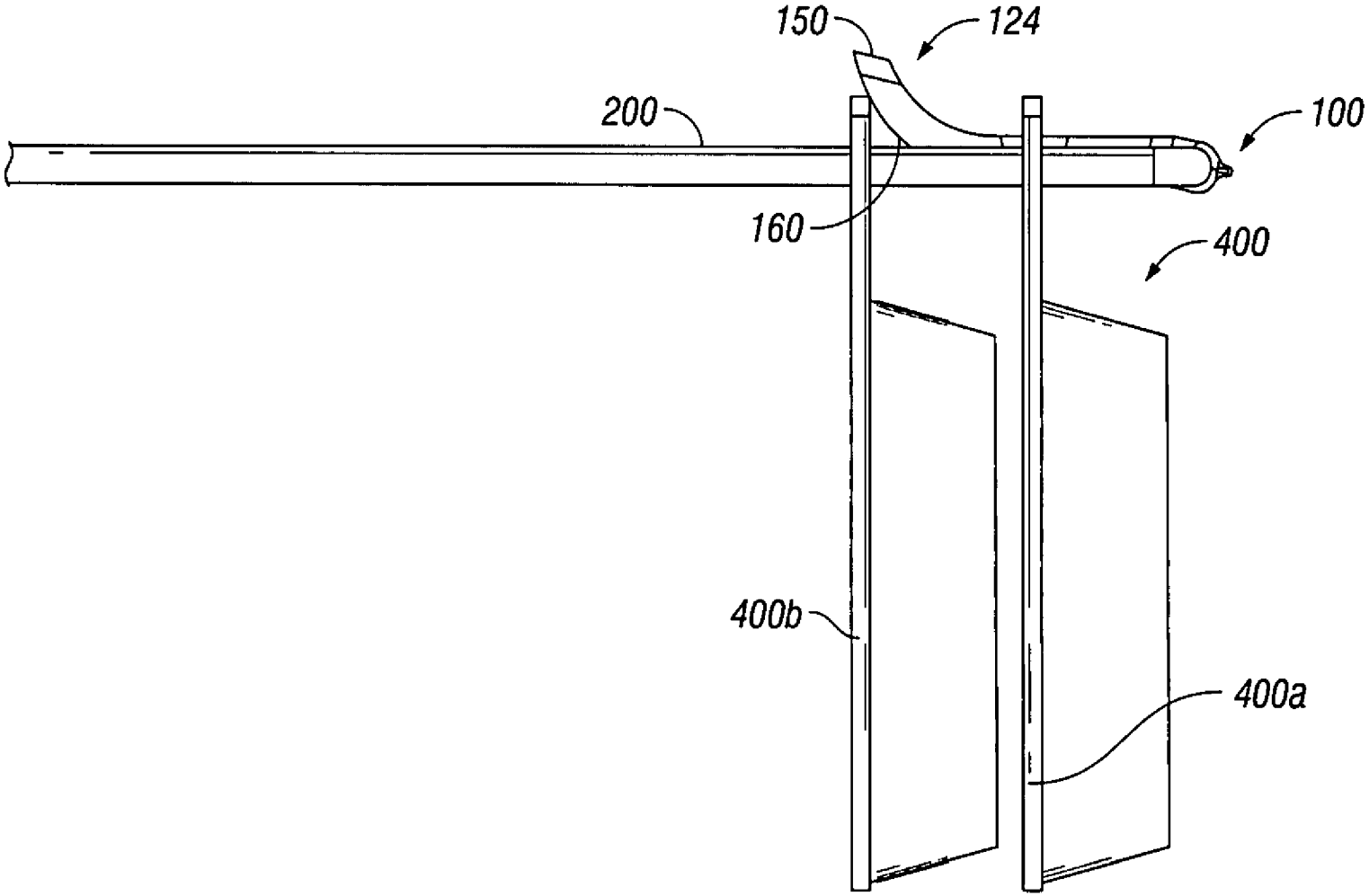
FIG. 7 is a side view of the anti-sweep apparatus and wire of FIG. 6.

With reference to FIGS. 4-7, anti-sweep apparatus is movable between an enabling orientation (FIGS. 4 and 5) and a blocking orientation (FIGS. 6 and 7). Anti-sweep apparatus 100 only allows one article 400 to be removed from wire 200 at a time. Each article 400 includes a slot 410 disposed therethrough for insertion onto wire 200, as shown in FIGS. 4 and 6. Initially, and in its rest position, anti-sweep apparatus 100 is in its enabling orientation (FIGS. 4 and 5). In the enabling orientation, anti-sweep apparatus 100 allows a lead article 400*a* to be removed from wire 200, i.e., when distal tab 150 rests on wire 200. With reference to FIGS. 6 and 7, anti-sweep apparatus 100 is illustrated in a blocking orientation where anti-sweep apparatus 100 prevents a second article 400*b* (behind lead article 400*a*) from being removed from wire 200, i.e., when distal tab 150 is in an elevated position with respect to wire 200.

With continued reference to FIGS. 4-7, to remove lead article 400*a* from wire 200, a user pulls lead article 400*a* proximally. When lead article 400*a* moves proximally, lead article 400*a* slides over distal portion 124 of anti-sweep apparatus 100. Upon further pulling, lead article 400*a* contacts camming surface 160 of anti-sweep apparatus 100 (best seen in FIG. 5). This contact between lead article 400*a* and camming surface 160 cams distal portion 150 upward with respect to wire 200 and moves anti-sweep apparatus 100 towards its blocking orientation (FIGS. 6 and 7), thus preventing second article 400*b* from being able to be simultaneously removed from wire 200. Proximal set of tabs 140 of anti-sweep apparatus 100 is disposed proximal of a portion of camming surface 160 and prevents further upward movement of anti-sweep apparatus 100, thus creating an exit path for lead article 400*a*. Once lead article 400*a* is removed from wire 200, there is nothing holding anti-sweep apparatus 100 in its blocking position, thus anti-sweep apparatus 100 cams back to its original, enabling orientation. As can be appreciated, use of anti-sweep apparatus 100 only allows the removal of one article 400 from wire 200 at a time, thus preventing thieves from "sweeping" articles off of wire 200.

Anti-theft assembly, generally referred to as reference numeral 205, is illustrated in FIGS. 4 and 6. Anti-theft assembly 205 generally includes anti-sweep apparatus 100, as described above, wire 200 and a rear anti-theft device 300. Wire includes proximal portion 210 that is at least partially encapsulated by anti-sweep apparatus 100 and a distal portion 220 that may be mounted on an appropriate structure or surface, e.g., a peg board 250 (see FIG. 8). Distal portion 220 of wire 200 may be comprised of a single peg 230 (shown in FIGS. 4 and 6) or a plurality of pegs (not shown). Rear anti-theft device 300 is generally disposed adjacent distal portion 220 of wire 200 and hinders the removal of wire 200 from peg board 250.

A specific type of rear anti-theft device 300 illustrated in FIGS. 4 and 6 is a rotation lock 310. Rotation lock 310 prevents a thief from easily removing entire wire 200 from peg board 250 in order to quickly steal the articles 400 thereon. Rotation lock 310 is configured and dimensioned to only allow removal of wire 200 from peg board 250 by rotating wire 200 approximately 90° and then moving wire 200 proximally. This act of rotating wire 200 would be difficult for one to do when wire 200 contains articles 400 thereon. Further, a thief would not be likely to know how to remove wire 200 from peg board 250 when rotation lock 310 is in place.

Figure 8A:
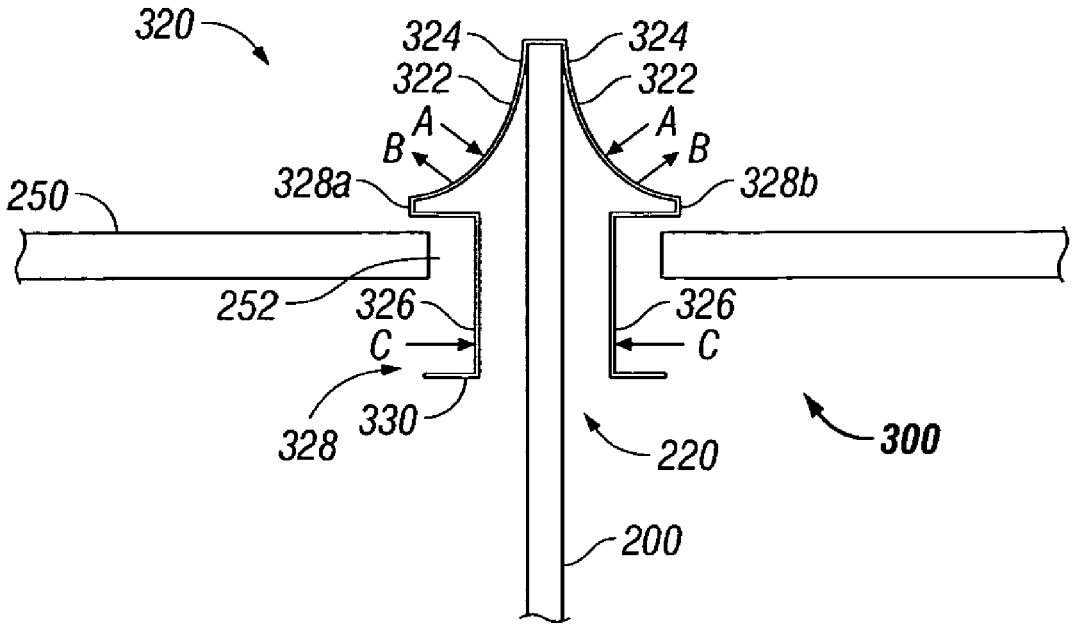
FIG. 8A is an enlarged top cross-sectional view of a locking mechanism disposed in a locked position adjacent a rear portion of the wire.
Figure 8B:
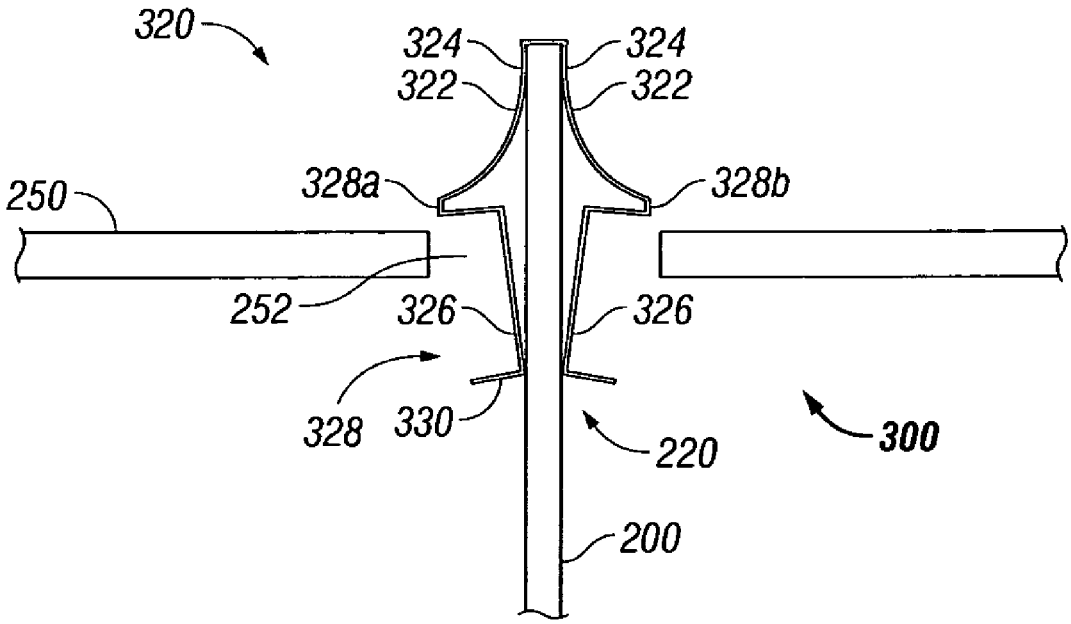
FIG. 8B is the locking mechanism of FIG. 8A disposed in an unlocked position.

A different type of rear anti-theft device 300 is shown in FIGS. 8A and 8B and is referred to as a spring lock 320. Spring lock 320 includes a pair of springs 322 (or a single spring radially disposed), each spring 322 having an arcuate portion 324, a straight portion 326 and a ridge portion 328. In operation, spring lock 320 is disposed adjacent distal portion 220 of wire 200.

Referring to FIG. 8A, to insert wire 200 with spring lock 320 into hole 252 of peg board 250, wire 200 is pushed distally. Distal movement of wire 200 forces arcuate portion 324 into peg board 250 and thus compresses arcuate portion 324 in direction of arrow A. A user continues to compress arcuate portion 324 until ridge portion 328 of spring lock 320 can fit through hole 252 of peg board 250. Once ridge portion 328 is through hole 252, arcuate portion 324 springs back in the direction of arrow B towards its original position, thus locking wire 200 into peg board 250, while leaving straight portion 326 on the proximal side of peg board 250. When spring lock 320 is expanded (FIG. 8A), the distance between first ridge portion 328*a* and second ridge portion 328*b* is larger than the diameter of hole 252 of peg board 250. When at least partially compressed (FIG. 8B), the distance between ridge portions 328*a*, 328*b* is smaller than diameter of hole 252.

With reference to FIG. 8B, to remove wire 200 from peg board 250, straight portions 326 of spring lock 320 are compressed in the direction of arrow C (FIG. 8A), thus reducing the distance between ridges 328*a*, 328*b*. Wire 200 can then be pulled from peg board 250 while straight portions 326 are being compressed. Such removal of wire 200 is difficult to accomplish when there are a plurality of articles 400 on wire 200. It is envisioned that stop members 330 are disposed on a proximal portion 328 of straight portions 326 to prohibit spring lock 320 from being fully inserted into hole 252 of peg board 250.

It is envisioned that spring lock 320 is mechanically attached adjacent distal portion 220 of wire 200. It is also envisioned that both locking devices 310, 320 are used in conjunction with one another. It is further envisioned that spring lock 320 may only be unlocked from an area located behind peg board 250, e.g., in a stock room.

While several embodiments of the disclosure have been shown in the figures, it is not intended that the disclosure be limited thereto, as it is intended that the disclosure be as broad in scope as the art will allow and that the specification be read likewise. Therefore, the above description should not be construed as limiting, but merely as exemplifications of various embodiments. Those skilled in the art will envision other modifications within the scope and spirit the claims appended hereto.

What is claimed is:

1. An anti-sweep apparatus for engagement with a wire which holds articles; comprising:

a first portion;

a second portion disposed proximate to the first portion;

a camming surface disposed on the first portion whereby the camming surface is engagable by a portion of a lead article on the wire to cam the anti-sweep apparatus between an enabling orientation where the lead article is removable from the wire and a blocking orientation where a second article is prevented from being removed from the wire;

a distal tab disposed on the first portion and distal of a portion of the camming surface, the distal tab being configured to contact the wire when the anti-sweep apparatus is in the enabling orientation; and wherein the first portion and the second portion are lockable with each other and whereby moving the second portion with respect to the first portion creates an opening therebetween which is sized to at least partially encapsulate a portion of the wire.

2. The anti-sweep apparatus according to claim 1, further comprising a proximal tab disposed on the first portion and proximal of a portion of the camming surface, the proximal tab being configured to contact the wire when the anti-sweep apparatus is in the blocking orientation.

3. The anti-sweep apparatus according to claim 1, further comprising a proximal tab disposed on the first portion and proximal of the distal tab, the proximal tab being configured to contact the wire when the anti-sweep apparatus is in the blocking orientation.

4. The anti-sweep apparatus according to claim 1, further comprising a living hinge disposed between the first portion and the second portion.

5. The anti-sweep apparatus according to claim 3, further comprising a living hinge disposed between the first portion and the second portion.

6. The anti-sweep apparatus according to claim 1, wherein the anti-sweep apparatus is configured to fit onto an unmodified wire.

7. An anti-theft assembly, comprising:

a wire for insertion into at least one hole on a structure and having a proximal portion and a distal portion, the wire capable of holding a plurality of articles thereon including a lead article and a second article disposed distally of the lead article;

an anti-sweep apparatus disposed adjacent the proximal portion of the wire, including:

a first portion and a second portion, the first portion being disposed adjacent the second portion;

a camming surface disposed on the first portion whereby the camming surface is engagable by a portion of the lead article to cam the anti-sweep apparatus between an enabling orientation which allows the lead article to be removed from the wire and a blocking orientation which prevents the second article from being removed from the wire; and wherein the first portion and the second portion are lockable with each other and whereby moving the second portion with respect to the first portion creates an opening therebetween which is sized to at least partially encapsulate a portion of the wire; and an anti-theft device disposed adjacent the distal portion of the wire and which hinders the removal of the wire from the structure.

8. The anti-theft assembly according to claim 7, wherein the anti-theft device is at least one of a rotation lock and a spring lock.

9. The anti-theft assembly according to claim 7, wherein the wire is a peg hook.

10. The anti-sweep assembly according to claim 7, further comprising a distal tab disposed on the first portion and distal of a portion of the camming surface, the distal tab being configured to contact the wire when the anti-sweep apparatus is in the enabling orientation.

11. The anti-sweep assembly according to claim 7, further comprising a proximal tab disposed on the first portion and proximal of a portion of the camming surface, the proximal tab being configured to contact the wire when the anti-sweep apparatus is in the blocking orientation.

12. The anti-sweep assembly according to claim 7, further comprising a locking structure disposed on at least one of the first portion and the second portion.

13. The anti-sweep assembly according to claim 7, further comprising a living hinge disposed between the first portion and the second portion.

* * * * *